United States Patent [19]

Valiulis

[11] Patent Number: 4,783,033

[45] Date of Patent: Nov. 8, 1988

[54] HANGER ASSEMBLY WITH U-SHAPED HANGER

[75] Inventor: Stanley C. Valiulis, Rockford, Ill.

[73] Assignee: Southern Imperial, Inc., Rockford, Ill.

[21] Appl. No.: 79,523

[22] Filed: Jul. 30, 1987

[51] Int. Cl.[4] ..... E04G 3/00

[52] U.S. Cl. ..... 248/220.4; 211/59.1

[58] Field of Search ..... 248/220.3, 220.4, 221.1, 248/221.2; 211/57.1, 54.1, 59.1; 40/16.4, 19.5; 128/373, 363

[56] References Cited

U.S. PATENT DOCUMENTS

| | | | |
|---|---|---|---|
| 2,626,599 | 11/1952 | Hryhorczuk | 248/214 X |
| 3,912,084 | 10/1975 | Valiulis | 211/57 |
| 4,286,764 | 9/1981 | Pfeifer | 248/220.3 |
| 4,351,440 | 9/1982 | Thalenfeld | 211/57.1 |
| 4,394,909 | 7/1983 | Valiulis | 248/220.3 X |
| 4,452,360 | 6/1984 | Barnes | 211/59.1 |
| 4,520,978 | 6/1985 | Taub | 211/57.1 X |
| 4,540,093 | 9/1985 | Merl | 211/59.1 |
| 4,688,683 | 8/1987 | Thalenfeld | 248/220.4 X |

*Primary Examiner*—J. Franklin Foss

*Attorney, Agent, or Firm*—Leydig, Voit & Mayer

[57] ABSTRACT

A hanger assembly includes a U-shaped hanger and a separate bracket for mounting the hanger on a perforated panel. The bracket is a standard bracket of the type disclosed in Valiulis U.S. Pat. No. 3,912,084. An attaching member having an inverted L-shaped configuration is welded to the inner end portion of the hanger and enables the hanger to be connected to the standard bracket.

6 Claims, 1 Drawing Sheet

HANGER ASSEMBLY WITH U-SHAPED HANGER

BACKGROUND OF THE INVENTION

This invention relates to a hanger assembly for supporting articles on a perforated panel of the type commonly referred to as a "Pegboard". Such an assembly includes a hanger adapted to project outwardly from the panel and adapted to hold merchandise. One type of hanger assembly is disclosed in Valiulis U.S. Pat. No. 3,912,084 in which the hanger is adapted to be releasably attached to the panel by a separate mounting bracket molded of plastic and having a pair of horizontally spaced fingers which extend through holes in the panel. Several well known advantages are obtained when the hanger assembly includes a hanger and a separate mounting bracket.

Brackets of the type disclosed in the aforementioned Valiulis patent have been widely used and have experienced outstanding commercial success. Such a bracket includes a plate adapted to lie flat against the panel and further includes a boss which projects forwardly from the plate. The boss is formed with an upwardly opening socket for receiving a depending finger located at the inner end of the hanger and also is formed with an upwardly opening notch for receiving the inner end portion of the hanger and preventing lateral swinging of the hanger.

The invention more specifically relates to a hanger assembly in which the hanger is generally U-shaped and is formed by upper and lower outwardly projecting arms whose inner ends are joined by an upright connector. The lower arm of such a hanger usually is used to hold merchandise while the upper arm supports a tag or the like having a price, a stock number and/or other indicia printed thereon.

A hanger assembly of the foregoing type is disclosed in Barnes U.S. Pat. No. 4,452,360. While the U-shaped hanger is advantageous in that its upper arm supports a tag or the like, the hanger requires a special bracket for attaching the hanger to the panel.

SUMMARY OF THE INVENTION

The general aim of the present invention is to provide a new and improved U-shaped hanger which may be used with brackets of the type disclosed in the Valiulis patent so as to enable such brackets to be employed universally with different types of hangers and to avoid the need of a special bracket for the U-shaped hanger.

A more detailed object of the invention is to achieve the foregoing through the provision of a U-shaped hanger having a novel attaching member enabling the hanger to be connected releasably to a Valiulis-type bracket.

The invention also resides in the relatively simple construction of the attaching member and in the manner in which the attaching member is connected to the hanger.

These and other objects and advantages of the invention will become more apparent from the following detailed description when taken in conjunction with the accompanying drawings.

DETAILED DESCRIPTION OF THE PREFERRED EMBODIMENT

Figure 1:
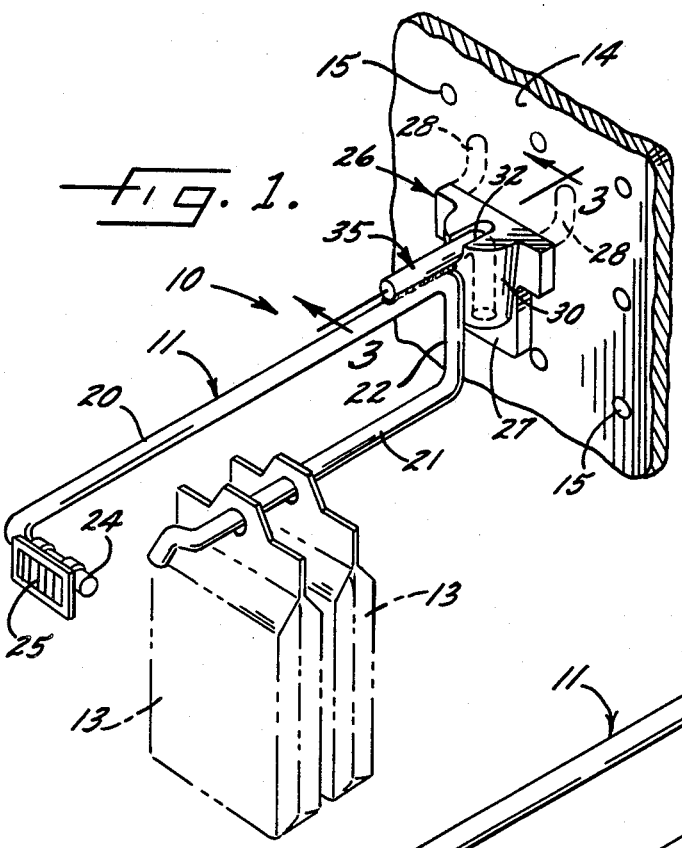
FIG. 1 is a perspective view showing a perforated panel and showing a new and improved hanger assembly incorporating the unique features of the present invention.
Figure 2:
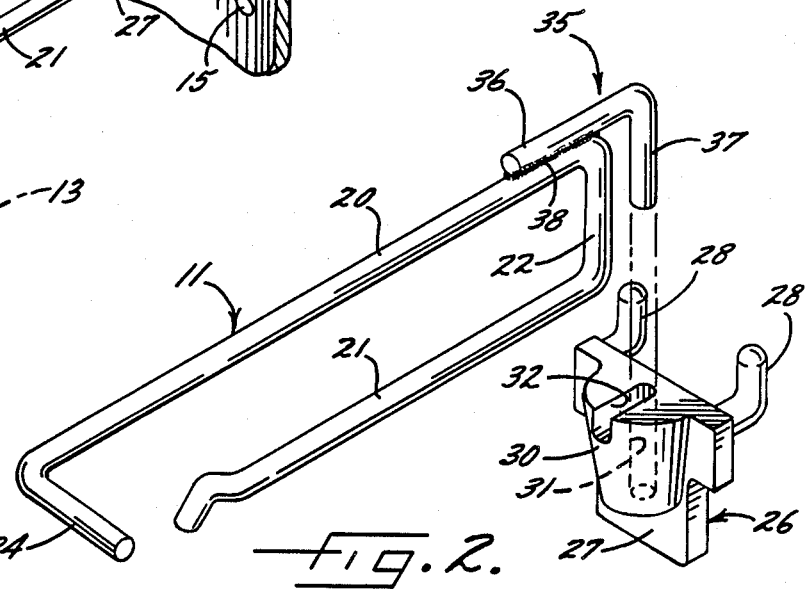
FIG. 2 is an exploded perspective view of the hanger assembly.
Figure 3:
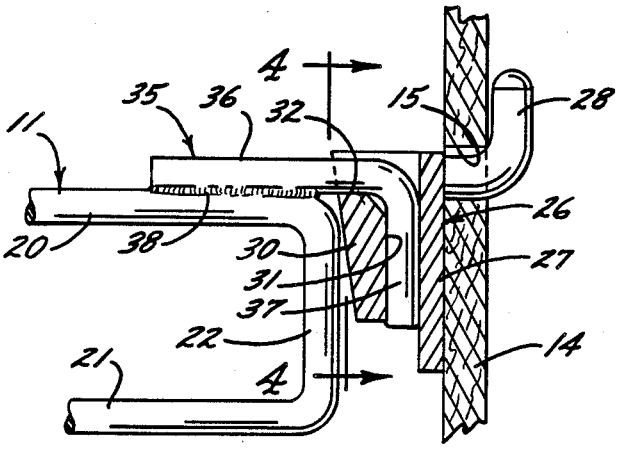
FIG. 3 is an enlarged fragmentary cross-section taken substantially along the line 3—3 of FIG. 1.
Figure 4:
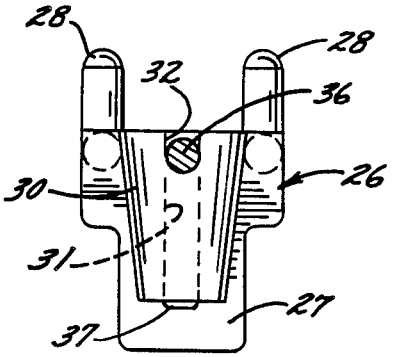
FIG. 4 is a cross-section taken along the one 4—4 of FIG. 3.

As shown in the drawings for purposes of illustration, the invention is embodied in a hanger assembly 10 having a hanger 11 for supporting one or more articles 13 from a panel or "Pegboard" 14 of the type formed with a series of vertically spaced and horizontally extending rows of holes 15. In this instance, the articles have been illustrated as being bags within which merchandise is contained. The upper end portion of each bag is formed with a hole to enable the bag to be hung from the hanger 11.

Herein, the hanger 11 is generally U-shaped and is made of round wire. The hanger includes upper and lower outwardly projecting arms 20 and 21 whose inner ends are formed integrally with and are joined by an upright connecting arm or connector 22. The lower arm supports the articles 13 while the outer end of the upper are is formed with a laterally projecting finger 24. A tag 25 is supported by the finger and contains indicia such as a price, a stock number of the like which is adapted to be "read" by an electronic inventory wand.

The hanger assembly 10 further comprises a mounting bracket 26 for attaching the assembly releasably to the panel 14. In this instance, the bracket is molded of relatively rigid but resiliently yeildable plastic such as polypropylene or Delrin and includes a generally rectangular plate member 27 normally disposed in an upright plane and adapted to lie flat against the outer face of the panel. Molded integrally with the upper end portion of the plate an projecting inwardly from the inner face thereof are two fingers or horns 28, each horn having a horizontal portion located adjacent the plate and merging gradually with an upwardly projecting vertical portion. By turning the plate 27 to a horizontal position with the ends of the horns 28 pointing toward the panel 14 and by moving the plate edgewise, the normally vertical portions of the horns may be inserted into two horizontally spaced holes 15 in one of the horizontally extending rows of holes formed in the panel. Thereafter, the plate may be swung downwardly and toward the panel to cause the horizontal portions to enter the holes and to cause the vertical portions to engage and interlock with the rear face of the panel just above the holes.

In accordance with the present invention, the bracket 26 is a standard and widely used bracket of the type disclosed in Valiulis U.S. Pat. No. 3,912,084 while the U-shaped hanger 11 is constructed in a unique manner enabling the hanger to be used with the standard bracket. As a result, the standard bracket 26 may be used interchangeably with standard hangers of the type disclosed in the Valiulis patent or with U-shaped hangers 11 of the type disclosed herein and there is no need to provide a special bracket for the present hanger.

More specifically, the bracket 26 includes an upright boss 30 molded integrally with the outer side of the plate 27. The boss is of semi-circular cross-section and tapers downwardly, the upper end of the boss being flush with the upper edge of the plate. A vertically extending hole 31 of circular cross-section is formed through the central portion of the boss and opens out of the upper end of the boss so as to define an upwardly opening socket. In addition, an upwardly opening and substantially U-shaped notch 32 is formed in the upper end portion of the boss 30 and extends outwardly from the hole 31 to the outer side of the boss. Thus, it is apparent that the present bracket 26 is identical to the bracket disclosed in the aforementioned Valiulis patent.

To enable the U-shaped hanger 11 to be connected releasably to the bracket 26, an attaching member 35 is connected to the hanger. Herein, the attaching member 35 is also made of round wire and is of an inverted L-shaped cross-section. Thus, the attaching member includes a generally horizontal leg 36 and a generally vertical leg 37 whose upper end is integral with the inner end of the horizontal leg. In this particular instance, the horizontal leg 36 of the attaching member 35 is welded rigidly at 38 to the upper side of the inner end portion of the upper hanger arm 20 and is located such that vertical leg 37 of the attaching member is spaced inwardly from the connector 22 of the hanger 11 by a distance at least equal to the maximum fore-and-aft dimension of the boss 30.

With the foregoing arrangement, the U-shaped hanger 11 may be attached releasably to the bracket 26 simply by telescoping the vertical leg 37 of the memer 35 into the vertical socket 31 of the bracket and by pushing downwardly on the hanger until the horizontal leg 35 of the member 35 seats in the U-shaped notch 32 of the bracket. By virtue of such seating, the hanger 11 is prevented form swinging laterally relative to the bracket 26 and is held at right angles to the panel 14.

I claim:

1. A hanger assembly adapted for attachment to an upright panel having horizontally spaced holes formed therethrough, said hanger assembly comprising a substantially U-shaped hanger having upper and lower arms adapted to project outwardly from the panel and having an upright connector extending between and joining the inner ends of the arms, said arms and said connector being disposed in a common upright plane, said hanger assembly further comprising a bracket for attaching said hanger to said panel, said bracket comprising an upright plate, a pair of horizontally spaced horns on the inner side of said plate and adapted to extend through two of said holes to attach said bracket releasably to said panel, an upright boss formed integrally with and extending outwardly from said plate, an upwardly opening socket formed in said boss, an upwardly opening notch formed in the upper end of said boss and extending outwardly from said socket to the outer side of said boss, and a member of inverted L-shaped configuration for attaching said hanger releasably to said bracket, said attaching member comprising a generally horizontal leg fastened to the upper side of said upper hanger arm and extending inwardly beyond said connector, said horizontal leg being sized to seat in the notch in said boss, and said attaching member further comprising an upright leg joined to and depending from the inner end of said horizontal leg and sized to fit into the socket in said boss.

2. A hanger assembly as defined in claim 1 in which said horizontal leg and said upright leg of said attaching member are made of wire and are integral with one another, said horizontal leg being welded to the upper side of said upper hanger arm.

3. A hanger assembly as defined in claim 2 in which said upright leg and said horizontal leg of said attaching member also are disposed in said common upright plane.

4. A hanger assembly adapted for attachment to an upright panel having horizontally spaced holes formed therethrough, said hanger assembly comprising, in combination, a substantially U-shaped hanger having upper and lower arms adapted to project outwardly from the panel and having an upright connector formed integrally with and extending between the inner ends of said arms, said arms and said connector being disposed in a common upright plane, said hanger assembly further comprising a bracket for attaching said hanger to said panel, said bracket comprising an upright plate, a pair of horizontally spaced horns on the inner side of said plate and adapted to extend through two of said holes to attach said bracket releasably to said panel, an upright boss formed integrally with and extending outwardly from said plate, an upwardly opening socket formed in said boss, an upwardly opening notch formed in the upper end of said boss and extending outwardly from said socket to the outer side of said boss, and a member of inverted L-shaped configuration for attaching said hanger releasably to said bracket, said attaching member comprising a generally horizontal leg fastened to the upper side of said upper hanger arm and extending inwardly beyond said connector, said horizontal leg being seated it the notch in said boss, and said attaching member further comprising an upright leg formed integrally with and depending from the inner end of said horizontal leg and telescoped into the socket in said boss.

5. A hanger assembly as define in claim 4 in which said upright leg and said horizontal leg of said attaching member also are disposed in said common upright plane.

6. A hanger assembly as defined in claim 5 in which said horizontal leg of said attaching member is welded to the upper side of said upper hanger arm.

* * * * *